US006202561B1

(12) United States Patent
Head et al.

(10) Patent No.: US 6,202,561 B1
(45) Date of Patent: Mar. 20, 2001

(54) SHOTSHELL HAVING PELLETS OF DIFFERENT DENSITIES IN STRATIFIED LAYERS

(75) Inventors: Lawrence P. Head, Cedar; Robert L. Kramer, Minneapolis; J. Bruce Warren, Plymouth; David C. Longren, Rogers, all of MN (US)

(73) Assignee: Federal Cartridge Company, Anoka, MN (US)

( * ) Notice: Subject to any disclaimer, the term of this patent is extended or adjusted under 35 U.S.C. 154(b) by 0 days.

(21) Appl. No.: 09/340,348

(22) Filed: Jun. 25, 1999

(51) Int. Cl.[7] ..... F42B 7/04; F42B 7/02

(52) U.S. Cl. ..... 102/460; 102/460; 102/454; 102/455; 102/430

(58) Field of Search ..... 102/454, 460, 102/455, 430

(56) References Cited

U.S. PATENT DOCUMENTS

| | | | | |
|---|---|---|---|---|
| 1,575,716 | * | 3/1926 | Pavek | 102/460 |
| 3,796,157 | * | 3/1974 | Anderson . | |
| 4,760,793 | * | 8/1988 | Herring, III | 102/460 |
| 5,264,022 | | 11/1993 | Haygarth et al. . | |
| 5,527,376 | | 6/1996 | Amick et al. . | |
| 5,760,331 | * | 6/1998 | Lowden et al. | 102/506 |
| 5,874,689 | | 2/1999 | Alkhatib et al. . | |

FOREIGN PATENT DOCUMENTS

| | | | | |
|---|---|---|---|---|
| 1262319 | | 10/1989 | (CA) . | |
| 562499 | * | 11/1923 | (FR) | 102/460 |

* cited by examiner

*Primary Examiner*—Michael J. Carone
*Assistant Examiner*—Lulit Semunegus
(74) *Attorney, Agent, or Firm*—Schroeder & Sigfried, P.A.

(57) ABSTRACT

A shotshell comprised of shot pellets of different densities and materials which provide increased effectiveness at both close and long range. Preferably the pellets are disposed in longitudinally stratified layers, with the more dense pellets located rearwardly of the pellets of lesser density. The pellets having the greater density maintain a closer pattern at long range, because they are preferably made of tungsten which has a high density and are located rearwardly, while the pellets having lesser density are preferably made of steel, describe a much wider pattern because of their lower density and forward location, and are therefore most effective at close range.

51 Claims, 5 Drawing Sheets

SHOTSHELL HAVING PELLETS OF DIFFERENT DENSITIES IN STRATIFIED LAYERS

BACKGROUND OF THE INVENTION

It has long been recognized that hunter's of small game often encounter a wide variety of shots with a shotgun which makes it extremely difficult to successfully bag game. For example, some game, particularly those which have previously been shot at, will try to escape either on the ground or in the air from a distance quite far from the hunter which necessitates a shotshell having a relatively long range effectiveness. On other occasions, similar game may seek to escape on the ground or in the air from a relatively short distance from the hunter, but will seek to escape at a sharp angle relative to the hunter which requires the latter to make "swing shots" which require greater accuracy. It is obvious that the hunter, for the latter situation, would benefit from a shotshell which, at short range, would have a relatively broad pattern of shot pellets in order to successfully bag the game. On the other hand, for the extended range shots, a shotshell having a "tighter pattern" of shot pellets would be more likely to enable the hunter to be successful in bagging the game. This is particularly true because of the fact that shot pellets commence to lose their energy immediately after leaving the muzzle of the gun, which results in the shot pellets fired at long range having lost a substantial amount of their energy. This difficulty is enhanced by the fact that shot pellets will have spread measurably by the time they reach long range distances, so fewer pellets are likely to strike the game or target.

Recent engineering trade-off studies indicate that the ideal balance between the effectiveness of a shotshell and its cost, involves incorporation of low-density shot spread into a wide pattern for shooting close-in targets, while for extended range shots, high-density shot pellets, held into a narrow pattern, are preferable. This is true because a pellet from a shotshell decelerates immediately after being launched from a shotgun and loses energy steadily with distance from the gun. High-density pellets, on the other hand, lose energy more slowly than do lower density pellets of the same diameter and material. Upon being launched at the same size and velocity, they start out with more energy due to greater mass. At any given range, the high-density material pellets will have more energy.

A game bird or other target is vulnerable only to pellets of a certain energy level which is a function of the size of the pellet, its velocity, and its mass. Within a certain range either low-density or high-density material pellets are capable of bringing down a game bird or other target. At greater ranges, however, only high-density pellets are capable of bringing down the same bird because the high-density pellet starts out with more energy and loses it at a slower rate. This is illustrated in FIG. 1 as shown hereinafter.

The pattern of pellets impacting a plane perpendicular to the line of flight of the shot stream is most dense close to the gun and less dense as the stream travels down range. This fact is well known in the art. One can envision this phenomena as a distribution of pellets moving away from the gun within a conical volume of space. "Tighter patterns" are characterized by a smaller cone apex angle. This indicates that close-in targets can be more effectively engaged with a wider pattern of shot, which is desirable. This occurs because at closer ranges, there is a wider pattern of lesser density pellets than of greater density, but there is still a high enough density of pellets per square foot to assure hitting the bird or other target with a sufficient number of pellets to assure downing it, even if not hit by the higher density shot pellets. A more dense pattern at such a close range would only do more damage to the meat of the game without greatly increasing the probability of bagging same. The advantage of the wide pattern at close range is that a bird or other target which is crossing the line of fire at close range requires a very fast sweep of the gun to track it, lead it and down it. This requirement makes proper pointing of the gun more difficult. The wider pattern of the lesser density pellets reduces the difficulty of the shot because it permits a greater miss distance for the center of the pattern with respect to the target, without letting the target get outside the effective pattern area.

Conversely, longer range shots require a tighter pattern spread angle. A loose pattern, suitable for close range work, results in a great separation between pellets at longer ranges. This markedly increases the possibility of missing the target with all of the pellets or else hitting the target with too few pellets to be effective. A tighter cone angle is needed to make a sufficiently high density of pellets in the pattern at long range. Thus, it can be seen that a wide distribution cone angle is best at close range and a narrow distribution cone angle is best at longer range.

Retained energy within the shot pellets is important at extended range and less so at short range. A lesser degree of retained energy is acceptable at short range, because it is far more likely at short range to have a greater concentration of pellets and will have higher velocity. The energy of the pellets at the muzzle of the shotgun is a function of their velocity and mass.

The velocity will be limited by the amount of propellant and the total mass of pellets. For a given amount of a selected propellant, the more mass that the pellets have, the lower the velocity will be. The system is muzzle energy constrained. Thus, it is not feasible to increase the number of pellets or the mass of the individual pellets without limit. The trade-off is between a large number of low-density pellets that are effective primarily at short range on one hand, or a relatively small number of high-density pellets which are effective at longer ranges, but less so at short range because of their limited number.

Game bird or other targets may present a shooting opportunity at either short, long, or intermediate range and the hunter does not have time to switch shells quickly enough to adjust to the situation at hand. The hunter will be best served by a shell which is effective at all ranges, including ranges that can not be attained by steel shot. Our invention provides an advantageous combination of short and long range effects.

The cost of the shell would depend in part on the cost per pound of the pellets and the number and size of any type of pellets employed. Higher density non-toxic shot pellets tend to be more expensive than low-density pellets such as steel. There is a fairly complex relationship between pellet material and size, propellant, velocity, pattern density, cost and effectiveness.

We have found that an excellent solution to all of the above considerations is to use both low and high density pellets in the same shotshell. An example would be to use tungsten-based shot pellets and steel shot pellets in combination. Other combinations, such as tungsten particles embedded in a polymer, can be used to advantage as well. Because of their relatively low density, a given number of steel pellets weigh less than the same size and number of pellets of a higher density material, and provides a higher velocity at all ranges exceeding zero. For a fixed number of pellets, higher density pellets of the same size increase the mass of pay load and reduce the maximum muzzle velocity. The tungsten-based or other high-density material pellets provide the ability to reach out farther in range, beyond the effective range of the steel pellets. To most effectively accomplish this, the high-density pellets should be limited, if possible, to a narrow distribution cone angle so as to maintain a sufficient pattern density at the extended range The steel pellets, on the other hand, should be spread over a wider pattern to increase the probability of hitting the game or other target at close range. Furthermore, by combining more expensive tungsten (or other high-density) pellets with much lower cost steel pellets, the cost of the product can be maintained at a lower level than can be accomplished with the same total number of high-density pellets, because of the typically high cost of high-density pellet materials The highest effective ranges of lead, steel, and tungsten are: lead 150–160 ft, steel 125 ft, and tungsten 160 ft. Tungsten is lighter than lead, but it holds its shape better and patterns better, so it performs better than lead. Our invention takes advantage of these phenomena.

BRIEF SUMMARY OF THE INVENTION

Our invention utilizes the above features to achieve maximum effectiveness over near and extended ranges and to reduce the overall cost of the shotshell. We do so by combining within each shotshell a combination of two different types of shot pellets, one of which is of relatively low-density and the other of which has a relatively high-density. By using different materials such as tungsten and steel, we obtain the benefit of their substantially different densities.

We preferably utilize a pair of longitudinally stratified layers of shot pellets within the shotshell casing. Preferably the lighter-density pellets are disposed most forwardly, and the heavier-density pellets are located therebehind. We have found that steel and tungsten-based shot pellets function most satisfactorily when so utilized, although other combinations have also performed satisfactorily.

Examples of other combinations include using other different materials. Thus, any one of the group of lesser-density metals which include steel, copper, iron, and tin, may be utilized as the low-density pellet. Any one of the group of metals which include tungsten, tungsten iron, tungsten polymer, bismuth, or copper, may be utilized as the high-density pellet. Steel is preferred as the low-density shot pellet because it is non-toxic, relatively light and inexpensive. Tungsten is preferred as the high-density shot pellet, despite its relatively high cost, because it is non-toxic, of relatively high-density and can be combined with a plurality of alloys to reduce its cost.

It will be noted that in the preceding paragraph, we have listed copper, both as a metal of greater and of lesser density. The reason for this is that copper has a density near both the lower level of the high density metals groups and the upper level of the group of lower density metals As a consequence, in certain situations, it may be desired to combine the metal having the highest density (such as tungsten) with one (such as copper) having a density adjacent the upper level of the lower density group. Since doing so would clearly violate the spirit of our invention, we are claiming such a combination, so as to bring it within the letter of our claims.

Although the preferred combination consists of using tungsten or one of its alloys as the high-density pellet and steel ahead thereof as the low-density pellet, we have found that a reversal of this arrangement yields results that are favorable, although less. We find that in the latter arrangement, the high-density pellets do not concentrate quite as much in the center of the pattern.

It is a general object of our invention to provide an improved shotshell which will provide more effective results at both close and extended ranges.

It is a further object of our invention to provide an improved shotshell which incorporates shot pellets of at least two (2) different densities for improved results at close and extended ranges.

Another object is to provide a shotshell having low-density shot pellets spread into a wide pattern for shooting at nearby targets, and high-density shot pellets held into a narrow pattern for extended range shots.

Another object is to provide a shotshell having an ideal balance between its effectiveness at all ranges and its cost.

Another object is to provide a shotshell having a wider pattern of shot pellets for targets at close-in targets, and a "tighter" pattern of shot pellets for targets at longer range.

Another object is to provide a shotshell which is effective at both close-in range and longer range, and can be produced at lower cost.

Another object is to provide a shotshell which produces a relatively wide distribution of shot pellets of a low density at close range, and a relatively narrow distribution of shot pellets of greater density at greater range, for increased effectiveness at longer range.

Another object of the invention is to provide a shotshell having a separate charge of lighter shot pellets for close-in range targets, in combination with a charge of heavier density shot pellets, for targets at longer range.

Another object is to provide an improved shotshell which incorporates those features needed to achieve maximum effectiveness over close and extended ranges while reducing the overall cost thereof.

These and other objects and advantages of the invention will more fully appear from the following description, made in connection with the accompanying drawings, wherein like reference characters refer to the same or similar parts throughout the several views, and in which:

DETAILED DESCRIPTION OF THE INVENTION

Figure 1:
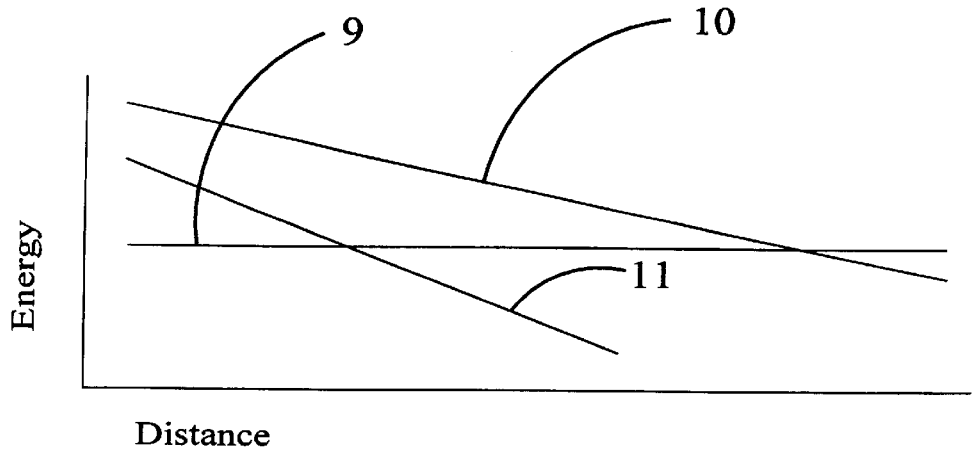
FIG. 1 is an idealized graph which illustrates the greater energy level of high-density shot and its greater killing range.

FIG. 1 shows an idealized draft which illustrates how high-density shot 10 compares with low-density shot shown by the line 11 when fired from the same gun. It can be readily seen that when the gun is fired, as illustrated, at a minimum distance (at the muzzle of the gun), the energy is high for each of the two (2) kinds of pellets. The required energy level for effectiveness is depicted by line 9. Because of the greater weight of the high-density shot, however, the energy in the high-density shot, as illustrated by the line 10, is substantially higher than the energy of the low-density shot, as illustrated by the line 11. Even more importantly, it can be seen that the high-density pellets maintain a much higher level of energy, as illustrated by the line 10 Such energy is sufficient to down the bird, and is maintained over a much greater distance, than is the case as illustrated by line 11 for the low-density pellets. It can readily be seen that high-density pellets maintain a much higher level of energy for a much greater distance.

Figure 2:
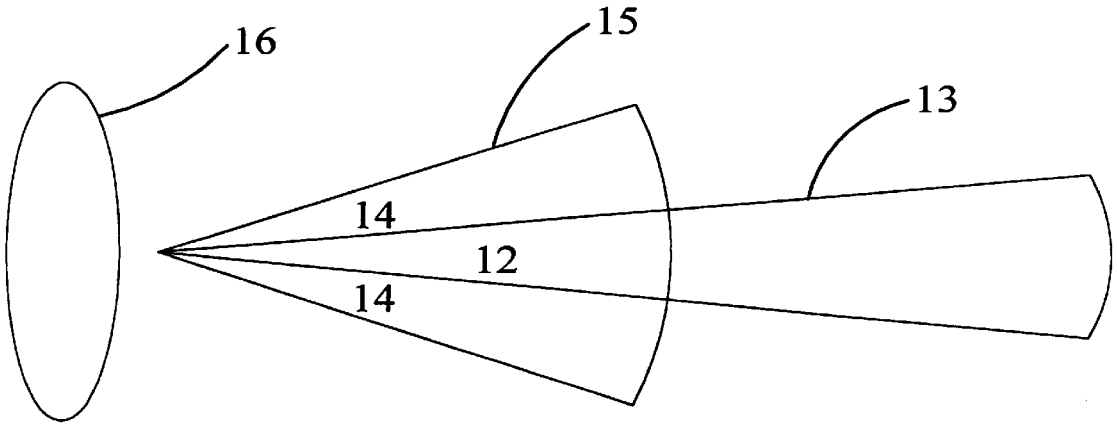
FIG. 2 is a diagrammatic representation of an idealized Shot Coverage of a dual-shot-material shotshell utilized in the invention.
Figure 3:
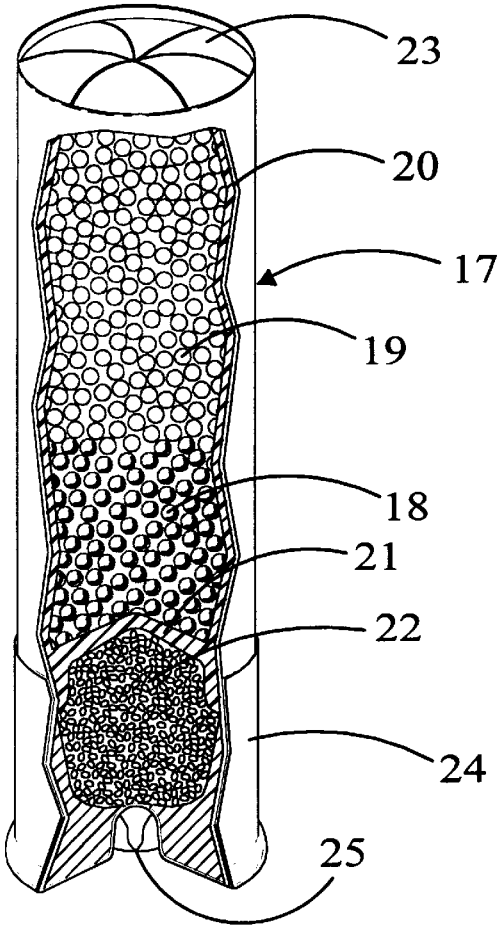
FIG. 3 is a partial vertical sectional view of a shotshell incorporating the preferred form of our invention, the pellets of greater density being disposed rearwardly of the pellets of lesser density and of the same size.

FIG. 2 is an idealized shot coverage diagram which illustrates the much smaller or tighter cone-angle 12 of the greater density pellets 13, as compared to the much wider cone-angle 14 of the lower density pellet 15. The numeral 16 represents the open end of the gun barrel. Thus, it can be seen that the greater density pellets are maintained in a much tighter cone-angle, and consequently are more lethal as they reach a long range target. The low-density pellets, on the other hand, cover a much larger area at the lower range and therefore are best adapted for effectiveness at the lower ranges FIG. 3 shows a shotshell casing 17 of the conventional type used for housing steel shot pellets, and identified by the numeral 17. As shown, the greater density pellets 18 are positioned behind the lower density pellets 19, each of which are housed within a plastic inner wad 20 of the type shown in U.S. Pat. No. 5,874,689 which is tubular in form and has a closed lower end 21. The propellant 22 is shown directly behind the bottom wall 21 of the tubular wad 20. The outer casing 17 of the shotshell has its upper end portions crimped inwardly to close the shell, as at 23. This is the preferred form of our invention. It will be seen that the shotshell has greater density pellets 18 and lesser density pellets 19, of equal size and disposed in separate stratum, the greater density pellets being disposed behind the pellets of lesser density. It will also be appreciated that the individual pellets 18 of greater density have a greater mass individually but are fewer in number, and hence have an equal total mass. A conventional head 24 and primer 25 complete the shotshell. The casing 17 and primer 25, as well as the tubular inner shot wad 20 are conventional items used in the art in the production of shotshells using steel shot pellets.

Figure 4:
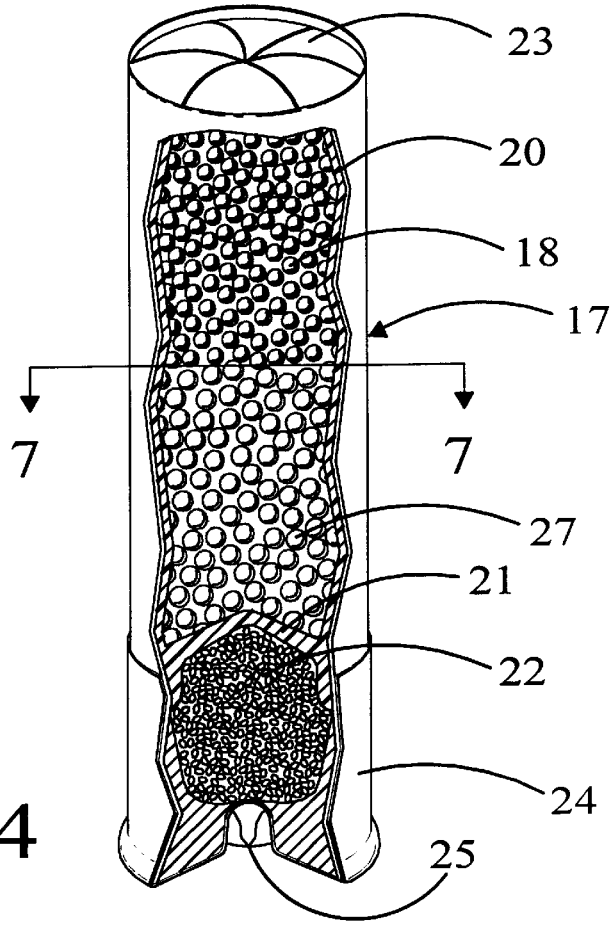
FIG. 4 is a partial vertical sectional view of a shotshell incorporating another form of our invention, the pellets of lesser density being disposed rearwardly of the pellets of greater density and larger in size.

FIG. 4 is a partial vertical sectional view of an identical casing 17 in which the high-density pellets 18 are disposed forwardly of the low-density pellets, identified by the numeral 27, because of the fact that they are larger in size than the pellets 19 in FIG. 3. The other portions of the shotshell are identical to that shown in FIG. 3 and therefore the various parts thereof are identified by the same numerals. In each of these views, the mass of the low-density pellets is equal to the mass of the high-density pellets and therefore, of course, the volume of the low-density pellets exceeds that of the high-density pellets 18.

FIG. 3 illustrates a preferred embodiment of our invention, wherein the high-density shot is contained in the shell behind the low-density shot. The head, primer, casing and interior shotcup are typical of shotshells manufactured for use with steel shot. The benefits obtained rest in the fact that two (2) different types of shot pellets, having different density materials (possibly of differing sizes), are packaged within the same shotshell.

Our tests show that when shotshells are constructed as shown in FIGS. 3 and 4 are fired, the lighter weight shot spreads rapidly and the heavier density shot pellets maintain a narrower pattern and consequently are more effective at longer ranges. Other tests show that improved results are obtained, even though the positions of the higher and lower density shot pellets are altered, as described hereinafter.

Examples of low-density shot which may be utilized in practicing our invention include iron, steel, copper and tin. Examples of high-density shot pellets which may be utilized in practicing our invention include tungsten, tungsten alloys, tungsten-polymer combinations, bismuth, copper, lead, and bismuth alloys or any other relatively high-density shot material. We have found that the use of both high and low density shot pellets achieves a maximum effectiveness at both near and extended ranges and reduces the overall cost of the product.

It should be understood that the preferred arrangement of shot is such that the low-density shot is disposed forwardly and the high-density shot is positioned to the rear. However, we have found that a reversal of this arrangement yields results that are only slightly less desirable. In the latter case, the high-density shot does not concentrate quite so much in the center of the pattern. This may be ideal for certain situations and thus an alternate order of loading the shot is included as part of this invention. Another possible combination is a mixture (non-stratified).

A classic problem of high-density material shot pellets is that their use may damage gun barrels if they impinge on the same while traveling down the barrel. When necessary, this invention may incorporate prior technology wad systems to assure protection of the barrel, such as is shown in FIGS. 3 and 4 by the use of the plastic tubular wad 20.

Figure 5:
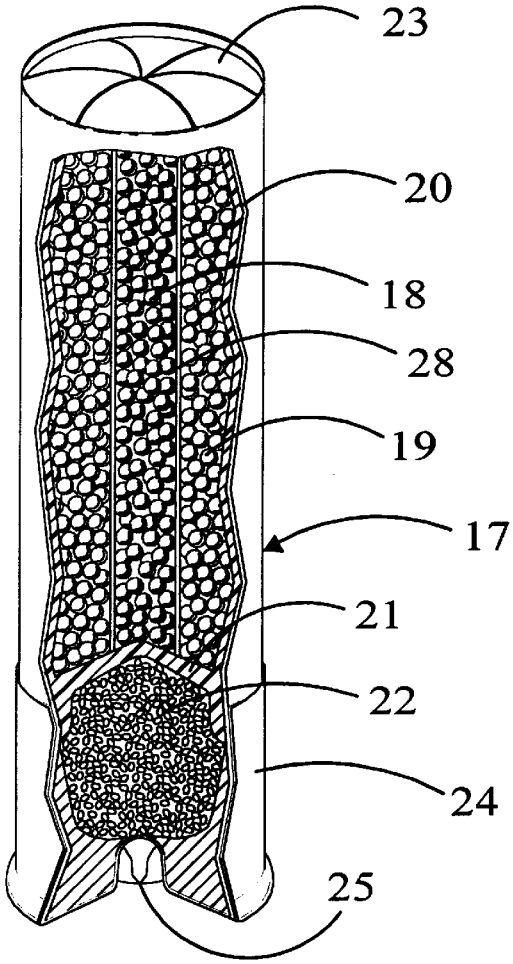
FIG. 5 is a partial vertical sectional view of a shotshell incorporating another form of our invention, in which the greater density pellets are disposed radially inwardly of the pellets of lesser density.

Another form of the invention is shown in FIG. 5 in which the tungsten pellets 18 are disposed within a cylindrical plastic tube 28 at the center of the casing 17. The lighter density steel shot 19 are disposed radially outwardly of the open-end cylindrical plastic tube 28, as shown therein. It is believed that this arrangement may prove to have certain advantages in that the pellets of greater density start from a position at the center of the two (2) charges and thus the charge of lesser density pellets 19 are more free to spread immediately upon exiting the muzzle of the gun. In addition, the central charge of pellets of greater density 18 are not subject to interference from the spreading pellets 19.

Figure 6:
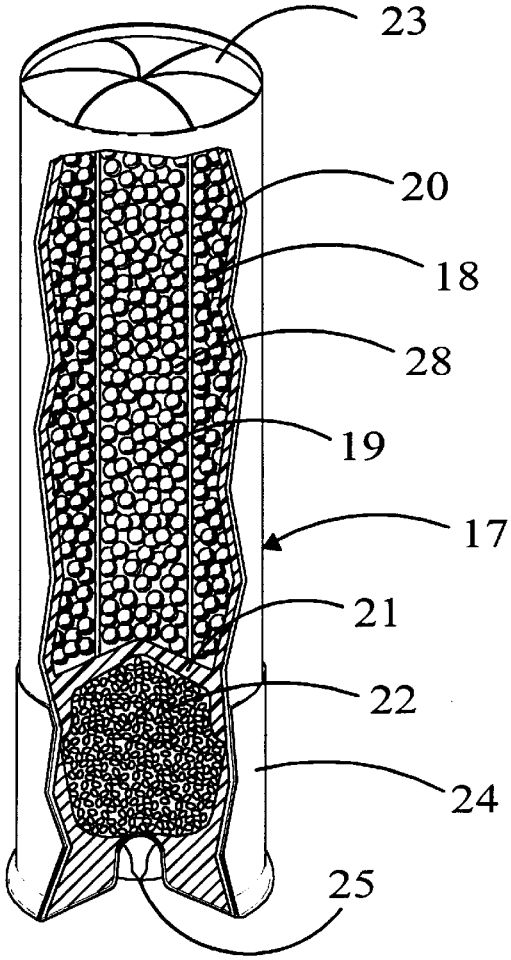
FIG. 6 is a partial vertical sectional view of a shotshell incorporating another form of our invention in which the greater density pellets are disposed radially outwardly of the lesser density pellets.

FIG. 6 shows an alternative arrangement of the pellets of greater and lesser density, the positions thereof being reversed as compared to that shown in FIG. 5. Thus, the pellets 19 having a lesser density are positioned along the axis of the shotshell within the plastic cylindrical tube 28, while the pellets 18 of greater density are arranged circumferentially around the exterior of the plastic tube 28.

Although it appears that the arrangement shown in FIG. 6 may not function quite as well as that shown in FIG. 5, the outward radial disposition of the pellets of greater density 18 is not likely to interfere materially with the spreading of the more centrally disposed pellets 19 of lesser density, for the reason that they will quickly out-distance the lighter pellets 19, so that the latter will be free to spread at will. For these reasons it is believed that the relative disposition of the greater and lesser density shot is not a material factor in the end results, in that the pellets 19 of lesser density will spread quickly and be effective for targets at shorter range, and the pellets 18 of greater density will carry on to greater ranges and be effective thereat.

Figure 7:
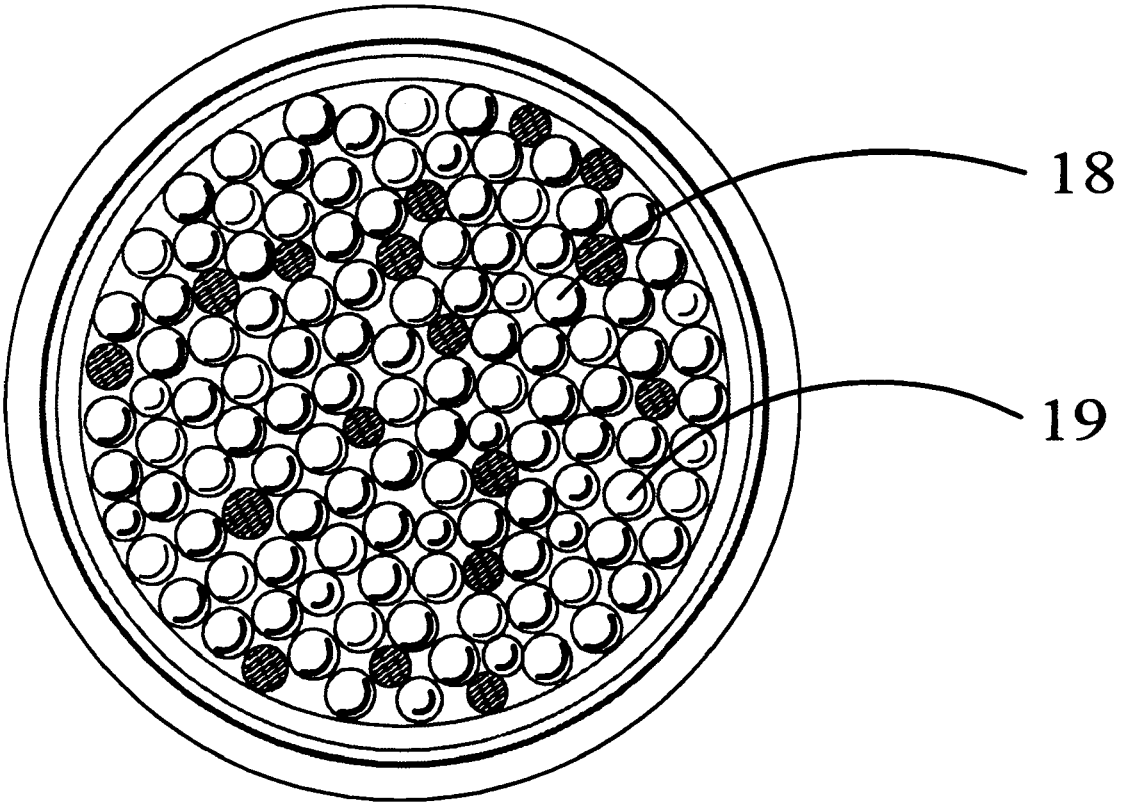
FIG. 7 is a transverse sectional view, taken along line 7—7 of FIG. 4, showing the greater and lesser density pellets slightly intermixed.

FIG. 7 is a transverse sectional view taken along line 7—7 of FIG. 4 and illustrates how the pellets of greater density 18 interengage, interfit and intermix with the pellets of lesser density at the line of juncture of the charge of such pellets with the charge of lesser density 19. Thus the latter, being steel shots are shown inter-mixed with the tungsten shot 18 at that line of juncture. We have found no evidence that the inter-mixing of the shots along that line causes any adverse results in our goal to furnish a shotshell which will perform effectively at both short and long ranges. Thus, although the charges of most of the various forms of our invention are described herein as being separate, they are not physically separated by a panel or the like, but instead, they bear against each other and their pellets intergageed, interfit and intermix slightly at their meeting ends.

Figure 8:
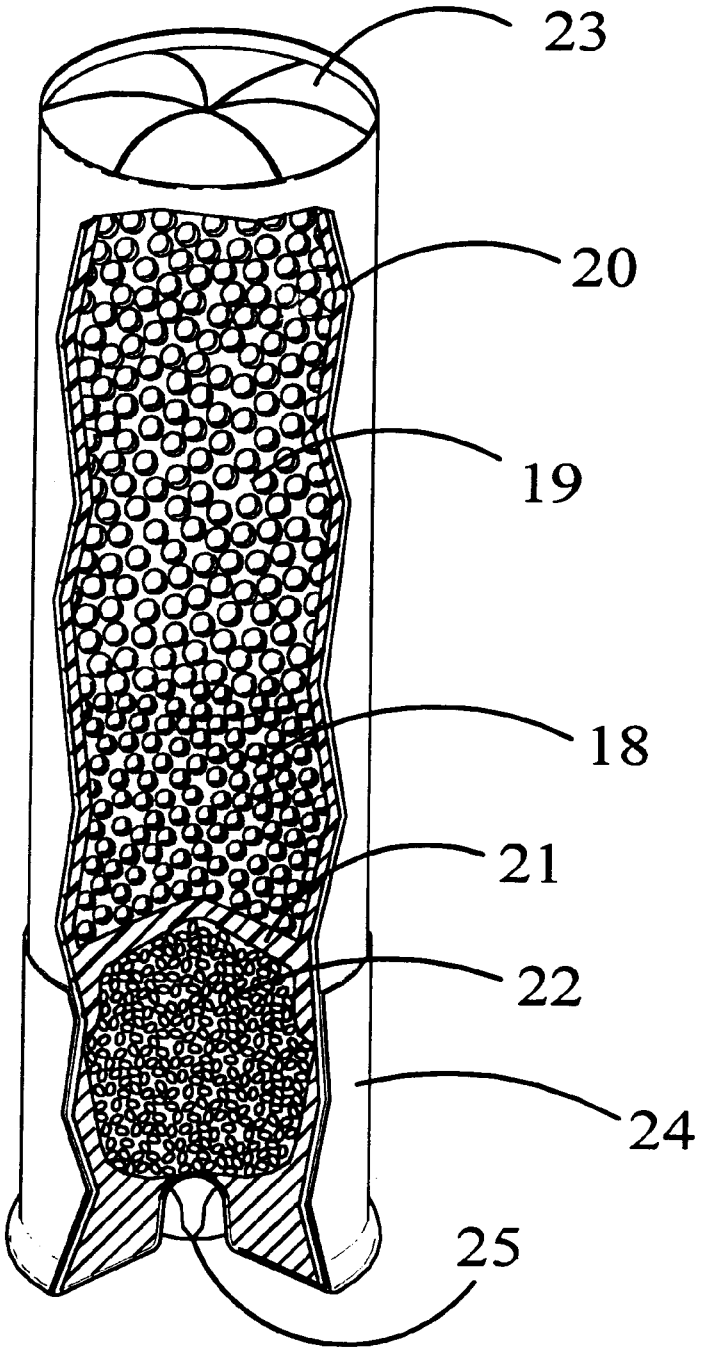
FIG. 8 is a partial vertical sectional view of a shotshell incorporating an additional form of our invention in which the pellets of lesser density are larger and having a greater total mass than the pellets of greater density and are located ahead of said pellets of greater density.

FIG. 8 is a view similar to that shown in FIGS. 3–6, inclusive, and differs only in that the pellets 19 of lesser density are larger and have a greater total mass than the pellets of greater density 18. As shown, the pellets of greater density are located behind the pellets 19 of lesser density. Here again, the changes in relative positions of the pellets of different densities does not appear to seriously adversely affect the effectiveness of the shotshell at either longer or shorter ranges.

The shotshells shown in FIGS. 3–8, inclusive, have proved to be a valuable and effective trade-off. The use of tungsten-based greater density pellets in combination with steel pellets has produced a combination which is very effective at short ranges. This is true because the lighter steel shot definitely spread more rapidly than the heavier tungsten-based shot. As a consequence, the steel shot is considerably more effective than the tungsten or lead shot would be at the short range. Conversely, the heavier tungsten shot is more effective at long range, since they tend to spread more slowly, and consequently have a more dense pattern at long range. Thus, each of these features of the invention as shown and claimed is an improvement in effectiveness of this shotshell. It should be noted that it is non-toxic since both tungsten and steel are non-toxic. Also, if any of the other non-toxic compositions are substituted for tungsten, and steel or tin is utilized as a pellet of low density, the product will be non-toxic.

In addition to the above, there is a cost trade-off which is effected as a result of utilization of steel pellets, Steel is substantially less expensive than most other metals utilized in shot pellets. It is sufficiently lower in price so that the use of the more expensive tungsten is off-set Further, the high price of tungsten can be further compensated for by using tungsten alloys.

As suggested above, the steel shot spread more rapidly and consequently are more effective at short range, as described. The tungsten shot pellets, on the other hand, spread more slowly and have a greater mass which causes them to retain its energy longer. As a result, the tungsten pellets have a tighter pattern when they reach the game target at long range and as a consequence, are more effective in downing the game bird, because the shot charge will have a greater concentration of individual tungsten pellets within the critical area surrounding the target. It should be noted that the tungsten-based shot, in combination with the steel shot, is particularly effective and appeals to be an ideal trade-off for the purpose indicated.

Wherever herein the term "largely" is utilized, it is intended to connote: exceeding most other things of like kind, especially in quantity or size.

Wherever herein the term "mainly" is utilized, it is intended to connote: for the most part.

Wherever herein the term "charge" is utilized, it is intended to connote: a quantity of shot pellets that a shotshell casing is intended to receive and is fitted to hold.

Wherever herein the term "stratified" is utilized, it is intended to connote: arranged generally in layers.

Wherever herein the term "forwardly" is utilized, it is intended to connote: a movement or position directed or located toward the mouth of the shotshell.

Wherever herein the term "rearwardly" is utilized, it is intended to connote: a movement or position directed or located toward the rear of the shotshell.

Wherever herein the term "tungsten polymers" is utilized, it is intended to connote a matrix with tungsten embedded in a plastic material, such as Nylon 6.

It will, of course, be understood that various changes may be made in the form, details, arrangement and proportions of the parts without departing from the scope of the invention which comprises the matter shown and described herein and set forth in the appended claims.

What is clained is:

1. A shotshell having longitudinally stratified layers of shot pellets having different densities by weight to provide increased effectiveness at both close and long range comprising:

(a) a shotshell casing having a head portion and a mouth portion;

(b) a primer located within said head portion;

(c) a propellant located adjacent to and ahead of said primer;

(d) a wad located within said casing ahead of said propellant;

(e) a longitudinally stratified payload of shot pellets positioned within said mouth portion; and (f) said payload including a charge of shot pellets each of which has a lesser density by weight and a separate charge of shot pellets each of which has a greater density by weight and is disposed rearwardly of said lesser density pellets.

2. The shotshell defined in claim 1, wherein said shot pellets having the greater density are comprised of material made up largely of tungsten.

3. The shotshell defined in claim 1, wherein said shot pellets of lesser density are comprised largely of steel.

4. The shotshell defined in claim 1, wherein said shot pellets of greater density consist mainly of material selected from a group consisting of lead, copper; bismuth, tungsten iron, tungsten polymers and tungsten.

5. The shotshell defined in claim 1, wherein said shot pellets having the lesser density consists mainly of material selected from a group consisting of steel, iron, copper and tin.

6. The shotshell defined in claim 1, wherein said shot pellets having the greater density are comprised largely of tungsten and said shot pellets having the lesser density are comprised mainly of steel.

7. The shotshell defined in claim 1, wherein said shot pellets having the lesser density are comprised mainly of steel, and said shot pellets having the greater density have a substantially greater density than steel.

8. The shotshell defined in claim 1, wherein said shot pellets having the greater density are comprised largely of copper.

9. The shotshell defined in claim 1, wherein said shot pellets having the greater density are comprised largely of bismuth.

10. The shotshell defined in claim 1, wherein said shot pellets having the greater density are comprised mainly of an alloy of tungsten.

11. The shotshell defined in claim 1, wherein said shot pellets having the lesser density are comprised largely of tin.

12. The shotshell defined in claim 1, wherein said shot pellets having the lesser density are comprised mainly of a metal having a density substantially less than that of tungsten.

13. The shotshell defined in claim 1, wherein the shot pellets of greater density are less in size than said shot pellets of lesser density.

14. The shotshell defined in claim 1, wherein the shot pellets of greater density are no greater in size than said shot pellets of lesser density.

15. The shotshell defined in claim 1, wherein said charge of shot pellets of greater density has a greater mass than that of said charge of shot pellets having a lesser density.

16. The shotshell defined in claim 1, wherein said charge of shot pellets of lesser density has a greater mass than that of said charge of shot pellets having a greater density.

17. A shotshell having longitudinally stratified layers of shot pellets having different densities by weight to provide increased effectiveness at both close and long range comprising:

(a) a shotshell casing having a head portion and a mouth portion;

(b) a primer located within said head portion;

(c) a propellant located adjacent to and ahead of said primer;

(d) a wad located within said casing ahead of said propellant;

(e) a longitudinally stratified payload of shot pellets positioned within said mouth portion; and (f) said payload including a plurality of stratified charges of shot pellets, the pellets of one of said charges being comprised of material different from the material of which the pellets of another of said charges are comprised, said different materials having different densities by weight, the pellets of the rearmost charge having a greater density than the pellets of said other charge.

18. A shotshell designed to provide increased effectiveness at both close and long range and having longitudinally stratified layers of shot pellets of different densities by weight, comprising:

(a) a shotshell casing having a head portion and a mouth portion;

(b) a primer located within said head portion;

(c) a propellant located adjacent to and ahead of said primer;

(d) a wad located within said casing ahead of said propellant;

(e) a stratified payload of shot pellets positioned within said mouth portion; and (f) said payload including a charge of shot pellets of lesser density by weight disposed within said mouth portion and a separate second charge of greater density by weight shot pellets within said mouth portion, said charge of pellets of lesser density interengaging, interfitting, and intermixing with the greater density pellets of said second charge at their juncture with said second charge and being disposed rearwardly of said second-mentioned charge whereby, upon said shotshell being fired, said shot pellets of lesser density will spread relatively rapidly within close range, and said pellets of greater density will effectively retain their velocity to a greater extent and be confined within a more narrow pattern at long range.

19. The shotshell defined in claim 18, wherein said shot pellets having the greater density being comprised of material made up largely of tungsten.

20. The shotshell defined in claim 18, wherein said shot pellets of lighter density are comprised largely of steel.

21. The shotshell defined in claim 18, wherein said shot pellets of greater density consist largely of material selected from a group consisting of lead, copper, bismuth, tungsten iron, tungsten polymer, and tungsten.

22. The shotshell defined in claim 18, wherein said shot pellets having the lesser density consist mainly of material selected from a group consisting of steel, iron and tin.

23. The shotshell defined in claim 18, wherein said shot pellets having the greater density are comprised largely of tungsten and said shot pellets having the lesser density are comprised largely of steel.

24. The shotshell defined in claim 18, wherein said shot pellets having the lesser density are comprised largely of steel, and said shot pellets having the greater density have a substantially greater density than steel.

25. The shotshell defined in claim 18, wherein said shot pellets having the greater density are comprised largely of copper.

26. The shotshell defined in claim 18, wherein said shot pellets having the greater density are comprised largely of bismuth.

27. The shotshell defined in claim 18, wherein said shot pellets having the greater density are comprised largely of lead.

28. The shotshell defined in claim 18, wherein said shot pellets having the lesser density are comprised largely of tin.

29. The shotshell defined in claim 18, wherein said shot pellets having the lesser density are comprised largely of a metal having a density substantially less than that of tungsten.

30. A shotshell having longitudinally stratified layers of shot pellets of different densities by weight providing increased effectiveness at both close and long range, comprising;

(a) a shotshell casing having a head portion and a mouth portion;

(b) a primer located within said head portion;

(c) a propellant located adjacent to and ahead of said primer;

(d) a wad located within said casing ahead of said propellant;

(e) a stratified payload of shot pellets positioned within said mouth portion; and (f) said payload being comprised of a plurality of interengaging and interfitting stratified charges, the density by weight of the pellets of at least one of said charges being greater than the density by weight of the pellets of another of said charges, said charge of greater density pellets being disposed behind said charge of lesser density pellets.

31. A shotshell having longitudinally stratified layers of shot pellets having different densities by weight to provide increased effectiveness at both close and long range, comprising:

(a) a shotshell casing having a head portion and a mouth portion;

(b) a primer located within said head portion;

(c) a propellant located adjacent to and ahead of said primer;

(d) a wad located within said casing, ahead of said propellant;

(e) a payload of shot pellets positioned in said mouth portion of said casing; and (f) said payload including a charge of individual lesser density by weight shot pellets, and a separate charge of individual greater density by weight shot pellets, one of said charges being disposed immediately behind and interengazaviny and interfittig with the other of said charges at their point of juncture whereby, upon said shotshell being fired, said shot pellets of lesser density will spread relatively rapidly within close range, and said pellets of greater density will effectively retain their velocity to a greater extent and be confined within a more narrow pattern at long range.

32. The shotshell defined in claim 31, wherein said pellets of lesser density are of greater size than said pellets of greater density.

33. The shotshell defined in claim 31, wherein said charge of shot pellets having lesser density are made largely of steel, and said charge of greater density are made largely of tungsten.

34. The shotshell defined in claim 31, wherein said shot pellets of lesser density are made largely of material selected from a group consisting of steel, iron, copper and tin.

35. The shotshell defined in claim 31, wherein said shot pellets of greater density are made largely of material selected from a group consisting of lead, copper, bismuth, tungsten iron, tungsten polymer and tungsten.

36. The shotshell defined in claim 31, wherein the pellets of the charge of greater density are comprised largely of tungsten.

37. The shotshell defined in claim 31, wherein the pellets of the charge of lesser density are comprised largely of steel.

38. The shotshell defined in claim 31, wherein said charge of greater density shot pellets has a mass in excess of the mass of said charge of lesser density shot pellets and is disposed rearwardly of said charge of lesser density shot pellets.

39. The shotshell defined in claim 31, wherein said charge of greater density shot pellets has a mass approximately equal to the mass of said charge of lesser density shot pellets and is disposed rearwardly of said charge of lesser density shot pellets.

40. The shotshell defined in claim 31, wherein said charge of greater density shot pellets has a mass less than the mass of said charge of lesser density shot pellets and is disposed rearwardly of said charge of lesser density shot pellets.

41. The shotshell defined in claim 31, wherein said charge of greater density shot pellets has a mass in excess of the mass of said charge of lesser density shot pellets and is disposed forwardly of said charge of lesser density shot pellets.

42. The shotshell defined in claim 31, wherein said charge of greater density shot pellets has a mass approximately equal to the mass of said charge of lesser density shot pellets and is disposed forwardly of said charge of lesser density shot pellets.

43. The shotshell defined in claim 31, wherein said charge of greater density shot pellets has a mass less than the mass of said charge of lesser density shot pellets and is disposed forwardly of said charge of lesser density shot pellets.

44. The shotshell defined in claim 31, wherein said pellets of said charge of greater density shot pellets are radially displaced relative to said charge of lesser density shot pellets.

45. The shotshell defined in claim 31, wherein said pellets of said charge of greater density shot pellets are disposed largely radially outwardly of said pellets of lesser density.

46. The shotshell defined in claim 31, wherein said pellets of said charge of greater density shot pellets are disposed largely radially inwardly of said pellets of lesser density.

47. The shotshell defined in claim 31, wherein at least some of said pellets of said charge of greater density shot pellets are intermixed with said pellets of said charge of lesser density shot pellets.

48. The shotshell defined in claim 31, wherein at least some of said pellets of said charge of lesser density shot pellets are intermixed with said pellets of said charge of greater density pellets.

49. The shotshell defined in claim 31, wherein said payload is comprised of a charge of shot pellets of lesser density intermixed with shot pellets of greater density.

50. A lead-free shotshell containing at least two charges of pellets of a single size, one of said charges being of lesser density by weight and another of said charges being of greater density by weight and being disposed behind the other.

51. A shotshell containing pellets of a single size and further comprising:

(a) a shotshell casing having a head portion and a mouth portion;

(b) a primer located within said head portion;

(c) a propellant located adjacent to and ahead of said primer;

(d) a wad located within said casing, ahead of said propellant;

(e) a payload of shot pellets positioned in said mouth portion of said casing; and (f) said payload including a charge of tungsten-containing pellets, and a charge of steel pellets, and said tungsten-containing, pellets being disposed to the rear of said steel pellets.

* * * * *

UNITED STATES PATENT AND TRADEMARK OFFICE

CERTIFICATE OF CORRECTION

PATENT NO. : 6,202,561 B1
DATED : March 20, 2001
INVENTOR(S) : Lawrence P. Head; Robert L. Kramer; J. Bruce Warren; and David C. Longren It is certified that error appears in the above-identified patent and that said Letters Patent is hereby corrected as shown below:

Column 1,
Line 7, delete "hunter's" and insert -- hunters --.

Column 3,
Line 9, after "range" insert -- . -- (a period).
Line 58, after "metals" insert -- . -- (a period).

Column 5,
Line 24, after "10" insert -- . -- (a period).

Column 7,
Line 27, delete "interengageed" and insert -- interengage --.

Claim 31,
Subparagraph (f), line 5, delete "interengazaviny and interfitting" and insert -- interengaging and interfitting --.

Claim 51,
Subparagraph (f), line 3, after "containing" delete "," (the comma).

Signed and Sealed this

Fifth Day of February, 2002

*Attest:*

*Attesting Officer*

JAMES E. ROGAN
*Director of the United States Patent and Trademark Office*